United States Patent [19]

Suzuki

[11] Patent Number: 4,844,029

[45] Date of Patent: Jul. 4, 1989

[54] HEATER FOR STARTING ENGINE

[75] Inventor: Yasuhiko Suzuki, Aichi, Japan

[73] Assignee: NGB Spark Plug Co., Ltd., Aichi, Japan

[21] Appl. No.: 870,080

[22] Filed: Jun. 3, 1986

[30] Foreign Application Priority Data

Jun. 4, 1985 [JP] Japan ..... 60-121201

[51] Int. Cl.[4] ..... F01M 5/02

[52] U.S. Cl. ..... 123/142.5 E; 123/196 AB; 219/205

[58] Field of Search ..... 123/142.5 E, 196 AB; 219/205

[56] References Cited

U.S. PATENT DOCUMENTS

| | | | |
|---|---|---|---|
| 1,754,080 | 4/1930 | Buggs et al. | 123/142.5 E |
| 1,764,021 | 6/1930 | Jackson | 123/142.5 E |
| 1,794,891 | 3/1931 | Gerhardt | 123/196 AB |
| 1,823,048 | 9/1931 | Hughes | 123/196 AB |
| 2,122,585 | 7/1938 | Pallack et al. | 123/142.5 E |
| 3,171,016 | 2/1965 | Sukala | 123/142.5 E |
| 3,953,707 | 4/1976 | Tanis | 123/142.5 E |

FOREIGN PATENT DOCUMENTS

| | | | |
|---|---|---|---|
| 0855315 | 11/1970 | Canada | 219/205 |
| 2070953 | 9/1981 | United Kingdom | 123/196 AB |

*Primary Examiner*—Willis R. Wolfe, Jr.

*Attorney, Agent, or Firm*—Finnegan, Henderson, Farabow, Garrett & Dunner

[57] ABSTRACT

A heater for starting an engine is disclosed which comprises a cast body and a sheathed heating element embedded in the body at the time of casting thereof and is secured to the outside surface of the lubricating oil accumulation part of the engine or a transmission case. The cast body is mounted so as to close a hole provided in the outside surface of the lubricating oil accumulation part.

10 Claims, 2 Drawing Sheets

HEATER FOR STARTING ENGINE

BACKGROUND OF THE INVENTION

1. Field of the Invention

The present invention relates to a heater for smoothly starting an engine in a cold region.

2. Description of the Prior Art

When the temperature of the air is −30° C. or below, it is difficult to smoothly start an engine because the fit of rotary and sliding portions of the engine is tight and the viscosity of lubricating oil of the engine is high. It is especially difficult to smoothly start an aircooled two-cycle engine in particular, at that temperature. Therefore, it is desirable to provide a means for heating the engine before and after the starting thereof. For a vehicle which is equipped with a water-cooled engine that is used in a very cold region, a heater for starting the engine has been provided to electrically preheat the cooling water of the engine.

Since lubricating oil and rotary and sliding portions lubricated by the oil cannot be directly heated by a conventional heater, the consumption of heating electric power is large and it takes a long time to raise the temperature of the lubricating oil and the rotary and sliding portions.

SUMMARY OF THE INVENTION

It is an object of the present invention to provide an engine heater which quickly raises the temperature of lubricating oil and rotary and sliding portions with a minimum of electric power.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

The engine heater provided according to the present invention comprises a cast body and a sheathed heating element embedded therein at the time of casting. The engine heater is secured to the outside surface of the lubricating oil accumulation part of an engine or a transmission case. Electrically is supplied from a power supply to the sheathed heating element.

The accompanying drawings, which are incorporated in and constitute a part of this specification, illustrate one embodiment of the invention and together with the description, serve to explain the principles of the invention.

DESCRIPTION OF THE PREFERRED EMBODIMENTS

Reference will now be made in detail to the present preferred embodiment of the invention, an example of which is illustrated in the accompanying drawings. Wherever possible, the same reference numbers will be used throughout the drawings to refer to the same or like parts.

Figure 1:
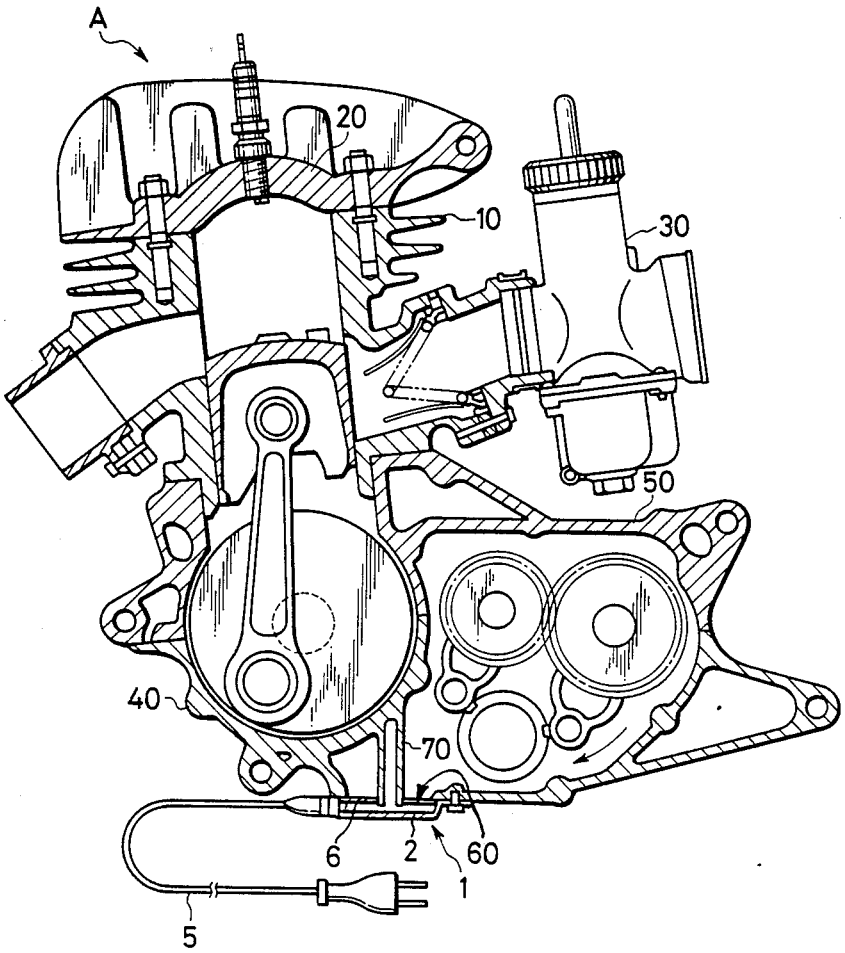
FIG. 1 shows a sectional view of an engine starting heater which is an embodiment of the present invention.

FIG. 1 show an air-cooled two-cycle engine A, a cylinder block 10, a cylinder head 20 clamped on the top of the cylinder block, and an intake pipe 30 clamped on a side of the cylinder block. A crankcase 40, which is cast integrally with a transmission case 50 in accordance with this embodiment, is clamped on the bottom of the cylinder block, and a hole 60 is provided in the lubricating oil accumulation part of the transmission case 50.

Figure 2:
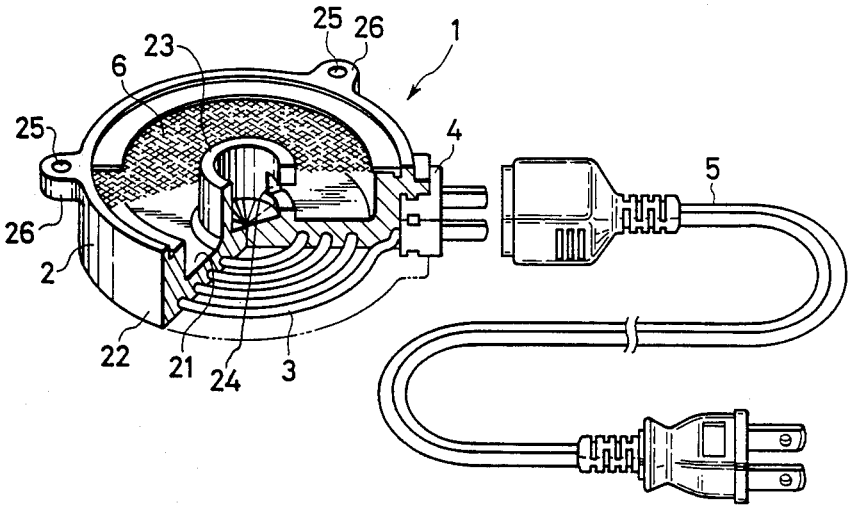
FIG. 2 shows a perspective view of the heater according to the preferred embodiment of the invention.
Figure 3:
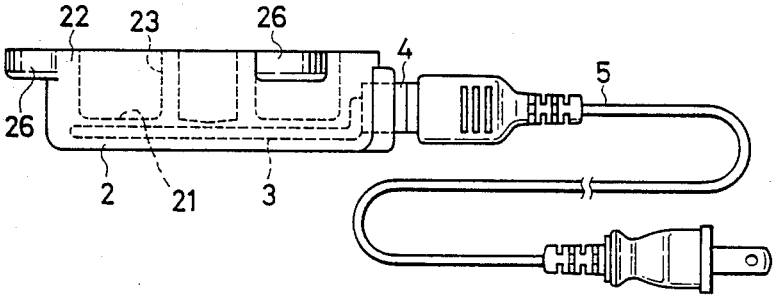
FIG. 3 shows a side view of the heater according to the preferred embodiment of the invention.

A heater 1 is clamped on the bottom of the transmission case 50 by bolts and closes the hole 60. As shown in FIGS. 2 and 3 in the heater 1, a sheathed heating element 3 bent in a desired form is embedded in a heater body 2 of the heater when the body is cast from a metal such as an aluminum alloy, whose melting point is lower than that of the metal sheath of the sheathed heating element. A plug 4 for connecting the sheathed heating element 3 to a commercial power supply is attached to the heater 1. Lead wires 5 are provided to connect the plug 4 to the commercial power supply.

The heater body 2 comprises a circular bottom plate 21, a peripheral wall 22 extending upwardly from the peripheral portion of the bottom plate 21, and a cylindrical part 23 extending upwardly from the central portion of the bottom plate 21. Communication holes 24 for connecting the interior of the cylindrical part 23 to the space between the part 23 and the peripheral wall 22 are provided in the lowermost portion of the cylindrical part 23. Flanges 26 having bolt insertion holes 25 project horizontally from the peripheral wall 22. The sheathed heating element 3 is embedded in the bottom plate 21 of the heater body 2.

As shown in FIG. 2, an annular oil filter 6 is fitted on the top of the body 2. When the engine A is working, lubricating oil from the transmission case 50 is filtered by the filter 6, as shown in FIG. 1. The filtered oil then accumulates at the bottom plate 21 of the heater body 2, flows into the cylindrical part 23 through the communication holes 24, and is sucked up through a suction port 70 by an oil pump (not shown in the drawings) or by a stirring action, so that the lubricating oil is forcibly supplied to rotary and sliding portions to lubricate them.

The heater 1 is used to heat the engine A in a very cold region in the main before the engine is started.

When the engine is an air-cooled two-cycle gasoline engine of 250 to 350 c.c. in displacement, the temperature of the air around the engine is −30° C. and the sheathed heating element 3 of 200 to 250W in output is supplied with electricity for 5 to 10 hours to heat the lubricating oil, the temperature of every part of the engine is raised from −10° to +30° C. The engine, which can hardly be started unless it is previously heated as described above, can be easily started if it is previously heated by the heater 1, because the cold-fitted staet of the rotary and sliding portions of the engine is eliminated by the raising of the temperature thereof.

Since the heater 1 is removably mounted on the oil accumulation part of the engine, the heater can easily be used for engines operating in moderately cold weather as well as for engines operating in very cold weather.

The heater 1 can be mounted not only on the bottom of the transmission case but also on the lubricating oil accumulation part of an engine section such as the crankcase 40 and the cylinder block 10.

When the engine to be started at a low temperature is heated by the engine heater provided according to the present invention, the electricity is supplied from the power supply such as a commercial power supply, or the electricity generator or battery of another vehicle, to the sheathed heating element 3 to directly heat the lubricating oil in the engine or the transmission case to quickly decrease the viscosity of the lubricating oil and loosen the fit of lubricated portions so as to minimize the consumption of the electricity. Other desirable effects are also produced as follows:

(1) Since the sheathed heating element is completely embedded in the cast body at the time of casting therof, the strength of the engine heater against vibration and shock is much higher than that of a conventional heater having a sheathed heating element welded, brazed or screwed to a cap.

(2) The heat exchange area of a conventional heater, whose sheathed heating element is inserted into a cap, is limited to the surface area of the sheathed heating element. The same is true for a conventional heater having a simply-dipped sheathed heating element. However, since the heat exchange area of the engine heater provided in accordance with the present invention and having the sheathed heating element embedded in the cast body of aluminum or the like is equal to the area of the contact of the cast body and a heated object, the heat exchange area is much larger than that of such a conventional heater as described above.

(3) As for the engine heater provided according to the present invention, the change in the design of the body of the engine, which is needed to mount the heater thereon, can be minimized.

(4) Since the engine heater provided according to the present invention to heat the lubricating oil has the sheathed heating element embedded in the cast body at the time of casting thereof, the size and weight of the heater and the number of parts thereof can be made smaller than those of a conventional heater whose sheathed heating element and cap are separately manufactured and then welded, brazed or screwed to each other.

Other embodiments of the invention will be apparent to the skilled in the art from consideration of the specification and practice of the invention disclosed herein. It is intended that the specification and examples be considered as exemplary only, with a true scope and spirit of the invention being indicated by the following claims.

I claim:

1. A heater for heating an engine, to facilitate the starting of the engine, comprising a cast body and a sheathed heating element embedded in said cast body at the time of casting thereof, said heater being secured to the outside surface of a lubricating oil accumulation part of one of said engine and a transmission case associated with said engine, wherein the cast body is mounted so as to close a hole provided in an outside surface of the lubricating oil accumulation part.

2. A heater according to claim 1, in which an oil filter is mounted on an inside surface of cast body.

3. A heater for heating an engine to facilitate the starting of said engine, said heater being attachable to said engine at a portion of said engine in which lubricating oil accumulates, comprising:

a cast heater body having an oil heating portion for receiving lubricating oil from said engine, and a sheathed heating element embedded in said oil receiving portion of said heater body during casting thereof for heating said lubricating oil.

4. The heater of claim 3, wherein said cast heater body further comprises retaining means for retaining the lubricating oil in the oil heating portion of the cast body during heating of said lubricating oil by said sheathed heating element.

5. The heater of claim 4, wherein said heater includes suction means for transporting the heated lubricating oil from said heater body to portions of the engine requiring said heated lubricating oil.

6. The heater of claim 5, wherein said heater includes a filter means for filtering the lubricating oil of the engine as said oil is received by the oil heating portion of the heater body.

7. The heater of claim 6, wherein said retaining means includes attaching means for attaching the heater to said engine, said heater sealing an opening in said portion of said engine in which lubricating oil accumulates.

8. The heater of claim 7, wherein said sheathed heating element includes a sheath made of a metal alloy, and wherein said heater body is made of a metal alloy, said heater body having a lower melting point than that of said sheath.

9. The heater of claim 8, wherein said heater body includes a suction area, said suction area being in fluid communication with the oil heating portion of the heater body for receiving heated lubricating oil from said oil heating portion of the heater body.

10. The heater of claim 9, wherein said suction means transports heated lubricating oil from said suction area of the heater body to said portions of the engine requiring said heated lubricating oil.

* * * * *